US005417772A

United States Patent [19]

Bavay et al.

[11] Patent Number: 5,417,772

[45] Date of Patent: May 23, 1995

[54] METHOD FOR PRODUCING A MAGNETIC STEEL STRIP BY DIRECT CASTING

[75] Inventors: Jean-Claude Bavay, Isbergue; Philippe Demarez, Labeuviere; Frédéric Mazurier, Bethune, all of France

[73] Assignees: Ugine S.A., Puteaux; Thyssen Stahl Aktiengesellschaft, Duisburg, both of France

[21] Appl. No.: 967,439

[22] Filed: Oct. 28, 1992

[30] Foreign Application Priority Data

Oct. 31, 1991 [FR] France ..... 91 13499

[51] Int. Cl.[6] ..... H01F 1/04

[52] U.S. Cl. ..... 148/110; 148/111; 164/477; 164/479; 164/480

[58] Field of Search ..... 148/111, 110; 164/477, 164/479, 480

[56] References Cited

U.S. PATENT DOCUMENTS

| | | | |
|---|---|---|---|
| 3,061,486 | 10/1962 | Jackson et al. . | |
| 3,115,430 | 12/1963 | Jackson et al. . | |
| 4,715,905 | 12/1987 | Nakaoka et al. | 148/111 |
| 5,049,204 | 9/1991 | Iwanaga et al. | 148/111 |
| 5,056,343 | 11/1991 | Nakashima et al. | 148/111 |
| 5,259,439 | 11/1993 | Blejde et al. | 164/480 |
| 5,259,443 | 11/1993 | Osada et al. | 164/480 |

FOREIGN PATENT DOCUMENTS

| | | |
|---|---|---|
| 0095352 | 11/1983 | European Pat. Off. . |
| 0390160 | 10/1990 | European Pat. Off. . |

OTHER PUBLICATIONS

Patent Abstracts of Japan, vol. 15, No. 6 (M-1066), Jan. 8, 1991 & JP-A-2 258 149, Isao, et al., "Production of Unidirectional High Magnetic Fulx Density Magnetic . . . ".

Iron and Steel Engineer, vol. 67, No. 7, Jul. 1990, pp. 51-55, J. A. Burgo, et al., "Thermal Design and Analysis of a Twin-Roll Caster".

*Primary Examiner*—George Wyszomierski

*Attorney, Agent, or Firm*—Oblon, Spivak, McClelland, Maier & Neustadt

[57] ABSTRACT

Method for producing a magnetic steel strip having a thickness of less than 5 mm and containing, in composition by weight, more than 2% silicon, less than 0.1% carbon and a suitable amount of secondary recrystallization inhibiting elements, the balance being iron, obtained by a direct casting on one roll or between two rolls, characterized in that it comprises creating a crystallization structure comprising oriented grains {110} <001> in the skin, i.e. on the surface of a quench zone, by the sudden cooling of the steel in contact with the roll or rolls whose surface temperature is lower than 400° C.

8 Claims, 1 Drawing Sheet

METHOD FOR PRODUCING A MAGNETIC STEEL STRIP BY DIRECT CASTING

The present invention relates to a method for producing a magnetic steel strip having oriented grains and a thickness of less than 5 mm and containing in composition by weight: more than 2% silicon, less than 0.1% carbon, secondary recrystallization inhibiting elements, the balance being iron, by a direct casting on a roll or between two rolls for producing the strip.

Oriented grain magnetic sheets are used in the manufacture of magnetic circuits, transformers and large rotating machines. In the case of applications of the transformer type, to obtain a steel having optimum magnetic performances, the crystallographic direction 001 which is the direction of easy magnetization, must be parallel to the rolling direction. In the conventional method for producing sheets having oriented grains, the continuously cast slabs are hot rolled on a strip rolling train and GOSS nuclei of orientation {110} <001> according to MILLER'S crystallographic notation are created during this rolling operation. By adding to the liquid metal composed of iron, silicon, carbon, manganese, aluminium, boron, antimony, tin, sulphur and/or nitrogen, inhibitors are formed such as MnS, AlN, BN and/or Sn and Sb which are partially precipitated or segregated in the hot rolled strip or precipitate in the course of subsequent heat treatments (annealing of the hot rolled strip and/or intermediate annealing between two cold rollings). If the prior thermal cycles are adequate, the dimensions of a sufficient amount of precipitates are less than 100 nanometers after decarburizing. The static final annealing in coils permits the selective growth of the GOSS nuclei coming from the hot rolling owing to the inhibition by the precipitates of the normal growth of the grains which do not have the desirable orientation. This is the phenomenon termed secondary recrystallization, the primary recrystallization having occurred during the decarburizing operation.

A new method for directly obtaining a thin strip whose thickness is less than 5 mm by casting liquid metal between two rolls or on one roll, permits eliminating the hot rolling so that the GOSS nuclei can no longer be created by hot rolling as in the conventional methods. It is consequently essential to determine new casting conditions which favour the existence of GOSS nuclei in the thin as-cast strip.

Thus, patent EP-A-O 390 160 teaches controlling the rate of secondary cooling of the thin strip obtained after solidification of the liquid metal; this rate must be higher than 10° C./s between 1300° and 900° C. in order to avoid the coarsening of the inhibiting precipitates which would eliminate the subsequent secondary recrystallization and formation of grains having the orientation {110} <001>. It is mentioned that if the secondary cooling rate between 1300° and 900° C. is too high, the columnar structure of the strip in the as-cast state has the texture {100} <ovw> with a number of GOSS nuclei close to zero, which does not permit envisaging the obtainment of the final thickness by a single cold rolling operation with a reduction rate higher than 80%. Indeed, under these conditions, the secondary recrystallization does not occur. If the secondary cooling rate is appropriate, higher than 10° C./s, the as-cast strip which underwent a recrystallization after solidification, is isotropic, namely has a random texture, and the grains do not have a preferential orientation. The secondary recrystallization is obtained, after a cold reduction rate higher than 80%, during a secondary recrystallization annealing.

An object of the invention is to provide a method for obtaining GOSS nuclei in a thin strip with no need to prescribe a specific secondary heat treatment.

The applicant has revealed that the control of the solidification conditions during the casting, and not the secondary cooling rate between 1300° and 900° C., is an essential parameter which governs the existence of the GOSS nuclei in a thin strip obtained by a direct casting of liquid metal between two rolls or on one roll.

The invention provides a method for producing a magnetic steel strip having a thickness of less than 5 mm, containing in its composition by weight more than 2% silicon, less than 0.1% carbon, a suitable amount of secondary recrystallization inhibiting elements, the balance being iron, this production being achieved by a direct casting on a roll or between two rolls, characterized in that said method comprises causing the formation of grains oriented {110} <001> in the skin, on the surface of at least one quench zone, by subjecting the steel to a sudden cooling by putting the steel in contact with the or each roll whose surface temperature is lower than 400° C.

One manner of carrying out the invention comprises:

casting the strip between two rolls cooled to a temperature lower than or equal to 400° C., applying between the rolls a pressure lower than 50 Kgf/mm of the width of the strip.

According to other features of the invention:

the surface temperature of the or each roll is preferably equal to or lower than 250° C.;

the thermal exchange coefficient at the cylinder/-solidified skin interface is higher than 0.10 cal/cm$^2$.s.° C., the skin of the strip is a quench zone solidified in accordance with a non-columnar basaltic mode, the thickness of the liquid metal at the core of the strip at the exit of the ingot mould is less than or equal to 30% of the total thickness of the strip.

The invention also provides a sheet having oriented grains obtained from a strip produced by the method according to the invention and characterized in that it comprises a columnar structure in the quench zone and a non-columnar basaltic structure comprising grains of the GOSS type in the skin.

It further comprises a central zone of equiaxial structure.

BRIEF DESCRIPTION OF THE DRAWINGS

The following description and the accompanying drawing given as non-limitative examples will explain the invention.

DETAILED DESCRIPTION OF THE INVENTION

According to the method of the invention, the control of the conditions of solidification permits obtaining GOSS nuclei in a thin strip obtained by direct casting in the case of a natural cooling, i.e. without use of a specific secondary cooling, for example spraying with water. Optionally, a secondary cooling may be used, but it does not then have for purpose to solve a metallurgical problem related to the structure. It may for example be imposed by technological stresses involved in coiling or by the desire to avoid a surface oxidation, and may be achieved for example by passing a neutral gas over the surface.

According to the invention, GOSS nuclei are created in the ingot mould by contact of the cast metal with the rolls owing to the optimization of the conditions of heat exchange between the liquid metal and the surface of the rolls, and these nuclei are preserved, below the plane containing the axes of the rolls, at the exit of the ingot mould, without the aid of a specific secondary cooling system, by the control of a parameter pertaining to the continuous casting method, for example the casting rate. In the examples described hereinafter for illustrating the invention, the devices for casting between two rolls are not provided with associated cooling systems, the cooling of the solidified strip occurring in the surrounding air.

Figure 1:
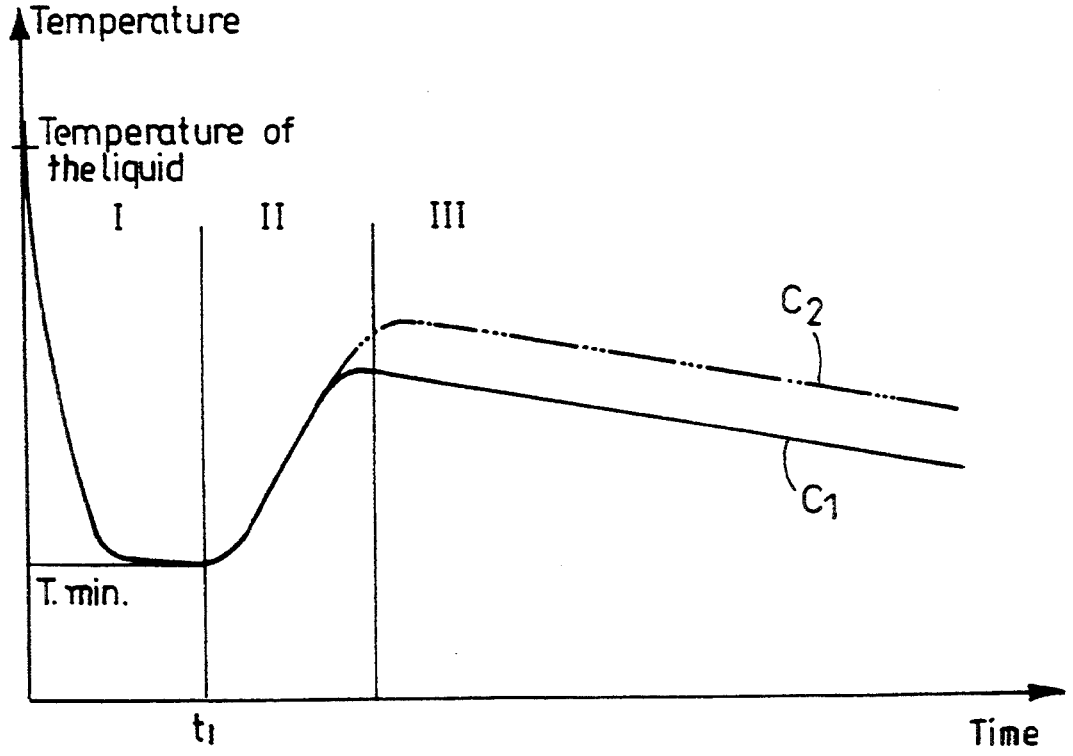
FIG. 1 shows the variation in the temperature of the surface of the strip in contact with the rolls and the temperature cycle of the skin at the exit of the ingot mould.

FIG. 1 represents the temperature of the surface of the strip in contact with the roll when the metal passes between the two rolls of the ingot mould in a continuous casting and the cooling cycle of the skin of the strip at the exit of the ingot mould.

The rolls cooled by circulation of water the surface of which is held at a temperature lower than 400° C., solidify the strip on the surface so as to form a quench zone whose skin undergoes a sudden variation in temperature shown by the temperature gradient of zone I. When the strip leaves the ingot mould, the core having a temperature higher than that of the quench zone raises the temperature of said skin (zone II). In the zone III, the skin is subjected to a natural cooling in the surrounding air requiring no use of an accelerated cooling, such as spraying with water. The curve C1 corresponds to a casting rate V1 and the curve C2 to a casting rate V2 V1.

Figure 2B:
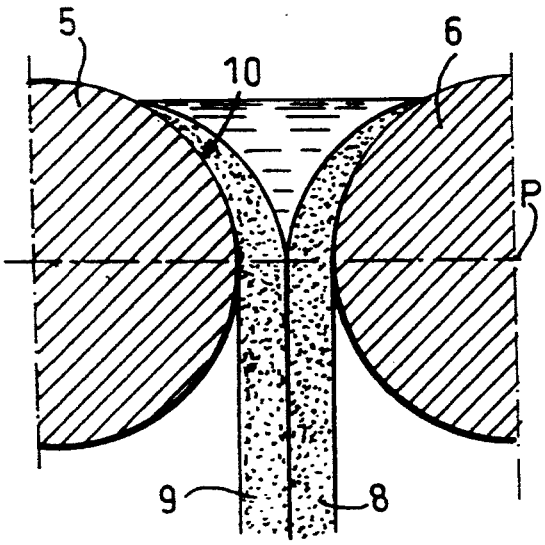
FIGS. 2A and 2B are sectional views of two strip structures leaving the ingot mould respectively corresponding to a speed of the rolls permitting the casting of a strip having a molten central zone at the exit of the ingot mould (FIG. 2A), and to a lower speed permitting the casting of a strip having no liquid central zone at the exit of the ingot mould (FIG. 2B).
Figure 2A:
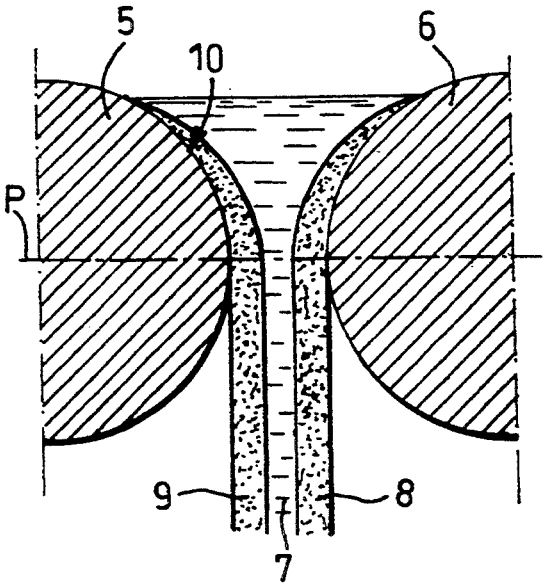

FIGS. 2A and 2B are two diagrammatic views of two structures leaving the rolls 5 and 6, respectively comprising, on one hand a liquid central zone 7 between two quench zones 8 and 9 (FIG. 2A) and, on the other hand two juxtaposed quench zones 8 and 9, the central zone 7 being solidified at the exit of the ingot mould (FIG. 2B).

Inspection of the microstructure of the Fe-Si strip in the state as cast between two rolls, was carried out on specimens in such manner as to reveal the GOSS nuclei. The polished specimens had been subjected to a first etching with dilute nitric acid so as to reveal the grain joints, then to a second etching with a reagent containing hydrofluoric acid and oxygenated water.

The corrosion figures thus obtained were used for determining the crystal orientations of the grains and the location of the GOSS nuclei. It is found that the GOSS nuclei are located at the extreme skin limit on the surface of the quench zone in contact with the surface of the roll. It concerns the part solidified in accordance with a non-columnar basaltic mode. To obtain GOSS nuclei at ambient temperature in as-cast products, their formation must be produced upon the first contact with the surface of the roll and they must be preserved by avoiding the coarsening of the adjacent columnar grains and by favouring their growth before the strip loses contact with the rolls at the exit of the ingot mould.

As shown in FIGS. 2A and 2B, the metal on the surface of the strip in contact with the cooled rolls undergoes a rapid cooling and, at the exit of the ingot mould, the skin is subjected to a reheating by the core which contains more or less liquid steel, as the case may be.

The parameters acting on the minimum temperature T min. attained by the skin in the ingot mould are:

the surface temperature of the roll held below 400° C. owing to the cooling power of the water circuits, to the thermal conductivity of the material constituting the surface of the roll, and to the geometric characteristics of the surface of the roll such as for example its roughness, its diameter, etc., the evolution of the thermal resistance at the interface between the surface of the roll and the skin in course of solidification. To create GOSS nuclei on the surface of the quench zone and preserve them before leaving contact with the surface of the roll, it is necessary according to the invention:

that the surface temperature of the roll be lower than 400° C., that the thermal exchange coefficient at the interface be higher than 0.10 cal/cm$^2$.s. C° throughout the length of the arc of contact 10. Under these conditions, the minimum temperature T min. attained by the skin at the exit of the ingot mould (zone I, FIG. 1) is lower than 1400° C., and the natural strip cooling rate (zone III, FIG. 1), substantially equal at the skin and at the core, is no higher than 100° C./s.

Below the plane P containing the axes of the rolls, as soon as the strip has left contact with the rolls, the extraction of heat is no longer as intense and the progression of the solidification front according to a columnar basaltic mode ceases. If the strip consists of two quench zones and a pasty central zone containing liquid and equiaxial grain nuclei (FIG. 2A), the cooling of the central zone through the solidified zones requires the dissipation of the latent heat of the liquid part and of the heat of the solid. As the skins are now only cooled by radiation, a reheating of the surface occurs. It is at this stage that the skin grains, and in particular the GOSS nuclei, may disappear. In the course of the reheating, the time spent in the temperature range where the mobility of the grain joints is effective is the important parameter. The list of the factors acting on the reheating temperature and the time spent in the range where the mobility of the grain joints (thermally activated phenomenon) is effective, is:

the proportion of the central zone having an equiaxial structure after solidification of the liquid, with respect to the total thickness of the strip;

the initial temperature of the skin determined by the different parameters of the installation.

It was observed that the number of GOSS grains per unit length of skin and the percentage of GOSS grains on the surface vary as a function of the percentage of the central zone and of the percentage of carbon of the solidified metal. The solidification structures were revealed by electrolytic etching in an aqueous solution containing 10% ammonium peroxodisulphate $(NH_4)_2S_2O_8$ which reveals the principal axes of the dendrites.

TABLE 1

Percentage of GOSS grains on the surface as a function of the percentage of the central zone and the percentage of carbon (casting between two rolls).

| | | | |
|---|---|---|---|
| Maximum temperature of the surface of the or each roll | 250° C. | 240° C. | 300° C. |
| Pressure of the rolls (kgf/mm width of the strip) | 10 | 7.5 | 10 |
| Thickness of the strip (mm) | 1.6 | 1.8 | 1.85 |
| Skin length observed in the casting direction (mm) | 750 | 850 | 400 |
| Percentage of central zone (%) (central zone thickness/strip thickness × 100) | 0 | 4 | 19.5 |
| % carbon of solidified metal | 0.005 | 0.005 | 0.020 |
| Number of GOSS grains/cm of skin | 1.8 | 0.6 | 3 |
| Percentage of GOSS grains on the surface | 2.8 | 1.5 | 8.8 |

The originality of the present invention resides in revealing the creation of GOSS nuclei in the ingot mould during the first contact of the liquid with the surface of the roll.

The limitation of the proportion of the central zone capable of reheating the skins and the carbon content are the means for preserving these nuclei. According to Table 1, the number of GOSS grains per cm of skin and the percentage of GOSS grains on the surface are much higher when the percentage of the central zone is zero (FIG. 2B) and when the carbon content is higher.

The relation the secondary recrystallization has to the maximum surface temperature and to the pressure of the rolls, to the thermal exchange coefficient at the interface between the roll and the solidified skin, to the number of GOSS grains per cm of skin, to the percentage of GOSS grains on the surface and to the carbon content, is illustrated by the following experiment of the direct casting of a thin strip between two rolls. Table 2 gives the chemical composition of the metal (percentages by weight).

TABLE 2

| C | Si | S | P | Mn | Cu | Soluble Al | N |
|---|---|---|---|---|---|---|---|
| 0.035 | 3.22 | 0.020 | 0.005 | 0.035 | 0.167 | 0.001 | 0.005 |

Table 3 gives the experimental conditions and structural characteristics of the strip cast between two rolls.

TABLE 3

| | |
|---|---|
| Maximum surface temperature of each roll | 350 |
| Pressure of the rolls (kgf/mm of the band width) | 18 |
| Casting rate (m/min) | 41 |
| Minimum temperature T min. | 1120° C. |
| Solidified strip cooling rate (Zone III, FIG. 1) | 55° C./s |
| Thickness of the strip (mm) | 3.1 |
| Thermal exchange coefficient (cal/°C.cm$^2$.s) | 0.17 |
| Percentage of the central zone (%) | 13 |
| % carbon of solidified metal | 0.035 |
| Number of GOSS grains per cm of skin | 1.3 |
| Percentage of GOSS grains on the surface | 5.6 |

Table 4 shows the different steps in the transformation of the pickled strip.

TABLE 4

| | |
|---|---|
| Reduction rate of the first cold rolling | 79% |

TABLE 4-continued

| | |
|---|---|
| Intermediate annealing | 980° C., 1 min 30 |
| Reduction rate of the second cold rolling | 55% |
| Decarburizing annealing | 870° C., 3 min |
| Mgo coating | |
| High temperature annealing | 1200° C., 20 h |

Under these conditions, there was obtained a complete secondary recrystallization, i.e. 100% GOSS grains at the final thickness of 0.28 mm. Bearing in mind the high carbon content (0.035%), the percentage of GOSS grains on the surface is nonetheless relatively high (5.6%) notwithstanding the fact that the percentage of the central zone is higher than 10%. It was revealed that GOSS grains are preserved on the surface even with a percentage of the central zone of the order of 30% if the carbon content is higher than 0.035%, the conditions of maximum surface temperature of the rolls and the pressure applied to the strip between the rolls being respectively lower than 400° C. and 50 kgf/mm, the thermal exchange coefficient being higher than 0.10 cal/cm$^2$.s.° C.

Moreover, the amount and the size of the manganese and copper sulphides resulting from the cooling of the strip in the calm surrounding air are compatible with the existence of a satisfactory inhibiting power. After the decarburizing annealing, many precipitates, identified by an electronic microscope in transmission, have a spherical shape about 10 to 100 nm in diameter. It is furthermore well known that the inhibiting power may be reinforced by addition of inhibitors to the magnesia which is used as an annealing separator for avoiding the adhesion between the turns of the coil during the secondary recrystallization annealing.

The invention is applicable to methods for the direct casting of thin strips between two rolls and on one roll for obtaining oriented grain sheets of conventional permeability or high permeability. It is applicable regardless of the inhibition mode (sulphides, selenides, nitrides, segregated elements) of the normal growth of the primary recrystallization grains favouring the selective growth of the GOSS grains and regardless of the subsequent treatment of the strip obtained by the direct casting of liquid metal on one roll or between two rolls. This subsequent treatment may comprise a single cold rolling with a high reduction rate (higher than 80%) for obtaining a high performance sheet or consist in a conventional treatment including two or more cold rollings with intermediate annealing(s).

The strip in the as-cast state may be subjected to an annealing before cold rolling, in particular for optimizing the size of the inhibitors. The cold rolling is followed by a line treatment of primary recrystallization and decarburization. Lastly, the final annealing of the coils after coating with a milk of magnesia to avoid the adhesion of the turns of the coil in a static furnace favours the secondary recrystallization phenomenon which leads to the selective formation of grains of orientation {110} <001>. The conditions for obtaining the strip between two rolls may be adapted in the case of casting on one roll or by a lateral supply of liquid metal to one roll. The grains of orientation {110} <001> are obtained under the same conditions, the pressure applied per mm of the width of the strip being nil. The GOSS grains are then only present on the side of the strip in contact with the roll.

The following Table 5 gives an example of the number of GOSS grains per cm of skin and of the percentage of GOSS grains on the single side in contact with the roll as a function of experimental conditions of casting on a single roll.

TABLE 5

| | |
|---|---|
| Surface temperature of the roll (°C.) | 280 |
| Casting rate (m/min) | 30 |
| Thickness of the strip (mm) | 1.38 |
| Percentage of the central zone | 0 |
| Percentage carbon of the solidified metal | 0.016 |
| Percentage of GOSS grains on the surface | 5.8 |

What is claimed is:

1. A method for producing a magnetic steel strip having a thickness of less than 5 mm, containing, in composition by weight, more than 2% silicon, less than 0.1% carbon, a suitable amount of secondary recrystallization inhibiting elements, the balance being iron, comprising the step of:

casting said steel directly on roll means for obtaining a strip, said roll means being two rolls between which two rolls said steel passes, maintaining on said roll means a surface temperature below 400° C. and having at the roll means/steel interface a thermal exchange coefficient higher than 0.10 cal/cm$^2$.s° C., thus subjecting said strip to a sudden cooling forming in said strip at least one quench zone having a solidified skin and causing formation of {110} <001> oriented grains in the solidified skin of said strip, wherein said roll means comprises a rolling surface cooled to a temperature below 400° C., while further applying a pressure on said strip during said casting step which is lower than 50 kgf/mm of a width of said strip such that the thickness of a layer of liquid metal at the core of said strip as it leaves said roll means is no more than 30% of the total thickness of said strip, the carbon content of the solidified strip being higher than 0.01%.

2. A method according to claim 1, wherein said temperature of said rolling surface of said roll means is lower than 250° C.

3. A method according to claim 1, wherein said skin of the strip on said surface of said at least one quench zone is solidified so as to produce a non-columnar basaltic structure.

4. A method according to claim 1, wherein the initial temperature of the solidified skin as it leaves said roll means is lower than 1400° C.

5. A method according to claim 1, wherein the rate of the natural cooling of the solidified strip is lower than 100° C./s.

6. A method according to claim 1, further comprising the steps, after casting, of first subjecting said strip to at least one cold rolling, next, a decarburizing and a primary recrystallization heat treatment, and a final secondary recrystallization annealing.

7. A method according to claim 6, further comprising annealing said strip after said cold rolling.

8. A method according to claim 6, further comprising annealing said strip after each said cold rolling.

* * * * *